US006267829B1

(12) United States Patent
Bäckerud et al.

(10) Patent No.: US 6,267,829 B1
(45) Date of Patent: Jul. 31, 2001

(54) METHOD OF REDUCING THE FORMATION OF PRIMARY PLATELET-SHAPED BETA-PHASE IN IRON CONTAINING ALSI-ALLOYS, IN PARTICULAR IN AL-SI-MN-FE ALLOYS

(75) Inventors: Lennart Bäckerud, Stockholm (SE); Lars Arnberg, Trondheim (NO); Guocai Chai, Sandviken (SE)

(73) Assignee: Opticast AB, Stockholm (SE)

( * ) Notice: Subject to any disclaimer, the term of this patent is extended or adjusted under 35 U.S.C. 154(b) by 0 days.

(21) Appl. No.: 09/043,296

(22) PCT Filed: Oct. 9, 1996

(86) PCT No.: PCT/SE96/01254

§ 371 Date: Aug. 27, 1998

§ 102(e) Date: Aug. 27, 1998

(87) PCT Pub. No.: WO97/13882

PCT Pub. Date: Apr. 17, 1997

(30) Foreign Application Priority Data

Oct. 10, 1995 (SE) ..... 9503523

(51) Int. Cl.[7] ..... C22C 21/02; C22C 21/04

(52) U.S. Cl. ..... 148/415; 148/549; 148/437; 148/438; 148/439; 148/440; 148/416; 148/417; 420/548

(58) Field of Search ..... 148/549, 437, 148/438, 439, 440, 415, 416, 417; 164/122, 458, 41; 420/548

(56) References Cited

U.S. PATENT DOCUMENTS 4,104,089 * 8/1978 Miki ..... 148/32.5
4,193,822 * 3/1980 Adam et al. ..... 148/3
4,434,014 * 2/1984 Smith ..... 148/3
4,973,363 * 11/1990 Hayato et al. ..... 148/3
5,019,178 * 5/1991 Barlow et al. ..... 148/3
5,217,546 * 6/1993 Eady et al. ..... 148/549
5,484,492 * 1/1996 Rogers et al. ..... 148/437
5,503,689 * 4/1996 Ward et al. ..... 148/549
5,762,728 * 6/1998 Kuramasu et al. ..... 148/549
5,846,350 * 12/1998 Bergsma ..... 148/549

OTHER PUBLICATIONS

JOM, Jan. 1991, s. Shivkumar et al, "Molton Metal Processing of Advanced Cast Aluminum Alloys", p. 26–p. 27.
Lennart Backerud et al, "Solidfication characteristics of aluminum alloys, vol. 2, Foundry Alloys", 1990, (Stockholm), p. 71–p. 84.
"The Effects of Iron in Aluminum–Silicon Casting Alloys—A Critical Review," Paul N. Crepeau No date !

* cited by examiner

*Primary Examiner*—Roy King
*Assistant Examiner*—Nicole Coy
(74) *Attorney, Agent, or Firm*—Nixon & Vanderhye

(57) ABSTRACT

The present invention is a method for producing an iron-containing hypoeutectic alloy free from primary platelet-shaped beta-phase of the $Al_5FeSi$ in the solidified structure by the steps (a) providing an iron-containing aluminum alloy having a composition within the following limits, in weight percent, 6–10% Si, 0.05–1.0% Mn, 0.4–2% Fe, at least one of 1) 0.01–0.8% Ti and/or Zr 2) 0.005–0.5% Sr and/or Na and/or Ba, 0–6.0% Cu, 0–2.0% Cr, 0–2.0% Mg, 0–6.0% Zn, 0–0.1 % B balance aluminum (b) controlling and regulating precipitation path during solidification such that the precipitation of Fe containing intermetallic phases starts with the precipitation of the hexagonal phase of the $Al_8Fe_2Si$ by (b1) controlling the condition of crystallization by addition of one or more of Fe, Ti, Zr, Sr, Na and Ba within the limits specified in step (a) and (b2) identifying the phases or morphology of the phases that precipitates during the solidification and correct the addition one or more times in order to obtain desired precipitation path and (c) solidifying the alloy at the desired solidification rate.

25 Claims, 3 Drawing Sheets

METHOD OF REDUCING THE FORMATION OF PRIMARY PLATELET-SHAPED BETA-PHASE IN IRON CONTAINING ALSI-ALLOYS, IN PARTICULAR IN AL-SI-MN-FE ALLOYS

The present invention relates to a method of producing iron-containing Al-alloys having improved mechanical properties, in particular improved fatigue strength, by controlling the morpholgy of the iron containing intermetallic precipitates.

BACKGROUND OF THE INVENTION

Iron is known to be the most common and at the same time most detrimental impurity in aluminium alloys since it causes hard and brittle iron-rich intermetallic phases to precipitate during soidification. The most detrimental phase in the microstructure is the beta-phase of the $Al_5FeSi$-type because it is platlet-shape. Since the detrimental effect increases with increasing volume fraction of the beta-phase much interest has focused on the possibilites of reducing the formation of said phase, as recently reviewed by P. N. Crepeau in the 1995 AFS Casting Congress, Kansas City, Mo., 23–26 April 1995.

The problem related to iron contamination of alumninium alloys is of great economical interest since 85% of all foundry allous are produced from scrap, the recycling rate is ever increasing (already higher than 72%) and the service life of aluminum is relatively short (of about 14 years). As a result thereof, the iron content in aluminium scrap continouosly increases since iron cannot be economically removed from aluminium. Dilution is the only practical method to reduce the iron content and the cost of aluminium is known to be inversely related to its Fe content. On the other hand, iron is deliberately added in an amount of 0.6–2% to a number of die-casting alloys, eg BS 1490: LM5, LM9, LM20 and LM24. Moreover, due to the low diffusivity of iron in solid aluminium there exist no practical possibility to reduce the deleterious effect of the iron containing precipitates by a heat treatment.

Iron has a large solubilty in liquid aluminium but a very low solubilty in solid aluminium. Since the partition ratio for Fe is quite low, iron will segregate during solidification and cause beta-phase to form also at relatively low iron contents as shown by Bäckerud et al in "Solidification Characteristics of Aluminium Alloys", Vol. 2, AFS/Skanaluminium, 1990. In said book the composition and morphology of iron containing intermetalic phases are detailed in relation to the Al-Fe-Mn-Si system.

The two main types occuring in Al-Si foundry alloys are the $Al_5FeSi$-type phase and the $Al_{15}Fe_3Si_2$-type phase. Moreover, a phase of the $Al_8Fe_2Si$-type may form. These intermetallic phases need not be stoichiometric phases, they may have some variation in composition and also include additional elements such as Mn and Cu. In particular $Al_{15}Fe_3Si_2$ may contain substantial amounts of Mn and Cu and could therefore be represented by the formula $(Al,Cu)_{15}(Fe,Mn)_3Si_2$.

However, for typing reasons the simplified formulas $Al_{15}Fe_3Si_2$, $Al_8Fe_2Si$ and $Al_5FeSi$ are preferred in the following. Accordingly, it is to be understood that compositional and stoichoimetrical deviations of the phases at issue are covered by the simplified formulas.

The $Al_5FeSi$-type phase, or beta-phase, has a monoclinic crystal structure, a plate like morphology and is brittle. The platlets may have an extension of several millimeters and appear as needles in micrographic sections.

The $Al_8Fe_2Si$-type phase has a hexagonal crystal structure and depending on the precipitation conditions this phase may have a faceted, spheroidal or dendritic morphology.

The $Al_{15}Fe_3Si_2$-type phase (often named alpha-phase), has a cubic crystal structure and a compact morphology, mainly of the chinese script form.

In the Al-Fe-Mn-Si system these three phases have been represented in the Si-$FeAl_3$-$MnAl_6$-equilibrium phase diagram as described by Mondolfo, FIG. 1. It may be noted that the $Al_{15}Fe_3Si_2$-type intermetallic is denoted $(Fe,Mn)_3Si_2Al_{15}$ in this figure. Point A represents the composition of a foundry alloy of the conventional A380-type and it can be seen that its original composition lies within the $(Fe,Mn)_3Si_2Al_{15}$ area. The solidification of such an alloy typically starts with the precipitation of aluminium dendrites and, in course of the solidifcation, the interdendritic liquid becomes sucessivley enriched in iron and silicon. As a result, the $Al_{15}Fe_3Si_2$-type intermetallic phase starts to precipitate (represented as$(Fe,Mn)_3Si_2Al_{15}$ in this diagram). Fe and Mn are consumed due to this reaction. The liquid moves towards the $Al_5FeSi$-area and starts to co-precipitate large platelets of $Al_5FeSi$-type phase until the liquid composition reaches the eutectic composition at point M in the phase diagram where the main eutectic reaction take place. For further details on the solidification of commersial aluminium foundry alloys, reference is given to Bäckerud et al, "Solidification Characteristics of Aluminium Alloys", Vol. 2, Foundry alloys, AFS/Skanaluminium, 1990.

As already pointed out, the primary platelet-shaped beta-phase of the $Al_5FeSi$-type is the most detrimental iron containing intermetallic phase in aluminium alloys because of its morphology. The large beta-phase platelets have been reported to decrease: ductility, elongation, impact strength, tensile strenght, dynamic fracture thoughness and impact thoughness. The effect has been attributed to: easier void formation, cracking of the platelets and microporosity caused by the large beta-phase platelets. In addition, the coarse beta-phase platelets have been reported to infer with feeding and castability and thereby increase the porosity. The perhaps most important effect of the platelets for many industrial applications is that they give rise to microporosity which is the most likely source of crack initiation.

In summary, it can be concluded that increased Fe may result in unexpected formation of the deleterios platelet-shaped beta-phase. The beta-phase forms above a critical iron content, causing the mechanical properties to decrease drastically.

Accordingly, in the prior art much work has been directed to the possibilites of avoiding the formation of beta-phase.

Prior art methods for reducing the formation of beta-phase can be grouped into the following four classes:

1. Control of Fe-content.
2. Physical removal of Fe.
3. Chemical neutralization.
4. Thermal interaction The first method is based on careful control and selection of the raw materials used (ie low-Fe scrap) or dilution with pure primary aluminium. This method is very costly and restricts the use of recycled aluminium.

The second method relates to sweat melting and sedimentation of iron rich intermetallic phases by the so called sludge. However, both methods result in considerable aluminium losses (about 10%) and are therefore economically unacceptable.

Chemical neutralization is, so far, the most used technique. Chemical neutralization aims at inhibit the platelet morphology by promoting the precipitation of the $Al_{15}Fe_3Si_2$-type phase which has a chinese script morphology by the addition of a neutralizing element. In the past, most work has been directed to use of the elements Mn, Cr, Co and Be. However, these additions have only been sucessful to a limited extent. Mn is the most frequently used element and it is common to specify % Mn>0.5(% Fe). However, the amount of Mn needed to neutralize Fe is not well established and beta-phase platelets may occur even when % Mn>% Fe. This method can be used to suppress the formation of beta-phase. However, it is to be noted that the total amount of iron containing intermetallic particles increases with increasing amount of manganese added. Creapeau has estimated that 3.3 vol. % intermetallic form for each weight percent of total (% Fe+% Mn+% Cr) with a corresponding decrease in ductility. In addition, large amounts of Mn are costly. Chromium and Co have been been reported to act similar as Mn and both elements suffer from the same drawbacks as Mn. Beryllium works in another way in that it combines with iron to form $Al_4Fe_2Be_5$, but additions >0.4% Be are required which causes high costs in addition to the safety problems related to the handling of Be since it is a toxic element.

The last method—thermal interaction—can be performed in two ways. Firstly, by overheating the melt prior to casting in order to reduce nucleating particles that form the detrimental phases. However, hydrogen and oxide contents increases, process time is consumed and costs are incurred. The second possibility is to increase the cooling rate in the combination with an addition of Mn. By increasing the cooling rate the amount of Mn needed decreases somewhat. Although this technique limits the drawbacks of the chemical neutralization by Mn it may be hard or impossible to put into practice in commercial foundry production, in particular for conventional casting in sand moulds and permanent moulds with sand cores.

Accordingly, the object of this invention is to propose an alternative method to avoid the formation of the deleterious plate like beta-phase in iron containing aluminium alloys. In particular, it is an object to propose a method which does not suffer from the above mentioned problems.

SUMMARY OF THE INVENTION

In accordance with the invention, this object is accomplished by the features of claim 1. Preferred embodiments of the method are shown in dependent claims 2 to 10. Claim 11 defines the use of thermal analysis for controlling the morphology of iron containing intermetallic precipitates in iron containing aluminium alloys according to claim 1 and claim 12 defines a preferred embodiment of claim 11.

The method according to this invention is based on the finding that the precipitation of platelet-shaped beta-phase of the $Al_5FeSi$-type can be suppressed by a primary precipitation of the hexagonal $Al_8Fe_2Si$-type phase. The presence of said $Al_8Fe_2Si$-type phase result in that when beta-phase precipitates it will not develop the common platlet-morphology but rather nucleate on and cover the $Al_8Fe_2Si$-type phase which in turn has a less harmful morphology.

The method of the invention has a number of advantages. Since the precipitation path during solidification can be controlled to avoid the formation of beta-phase platlets, the iron content need not be decreased. In apparent contrast to conventional practice, allowable iron contents may even be increased since iron can influence positively on the precipitation of $Al_8Fe_2Si$-type phase. As a result, cheaper raw material can be used. Due to the fact that Mn-additions can be avoided, alloy costs are saved and ductility increases as far as the total amount of iron containing intermetallic particles is reduced.

BRIEF DESCRIPTION OF THE DRAWINGS

The invention will now be described in relation to some examples and with reference to the accompanying figures in which:

FIG. 3 shows principally the result of a thermal analysis of a boron alloyed A380-type alloy represented in same way as in FIG. 2.

DETAILED DESCRIPTION OF PREFERRED EMBODIMENTS

Thermal analysis was performed for an A380 aluminium alloy with and without the addition of a crystallization modifying agent. The analysis of the base alloy is given in Table 1.

TABLE 1

Chemical composition of the base alloy A380 (in weight %).

| | |
|---|---|
| Si | 9.04 |
| Mn | 0.29 |
| Fe | 0.95 |
| Cu | 3.1 |
| Cr | 0.06 |
| Mg | 0.04 |
| Zn | 2.3 |
| Ti | 0.04 |
| Ni | 0.12 |
| Sr | <0.01 |

balance Al, apart from impurities.

Figure 1:
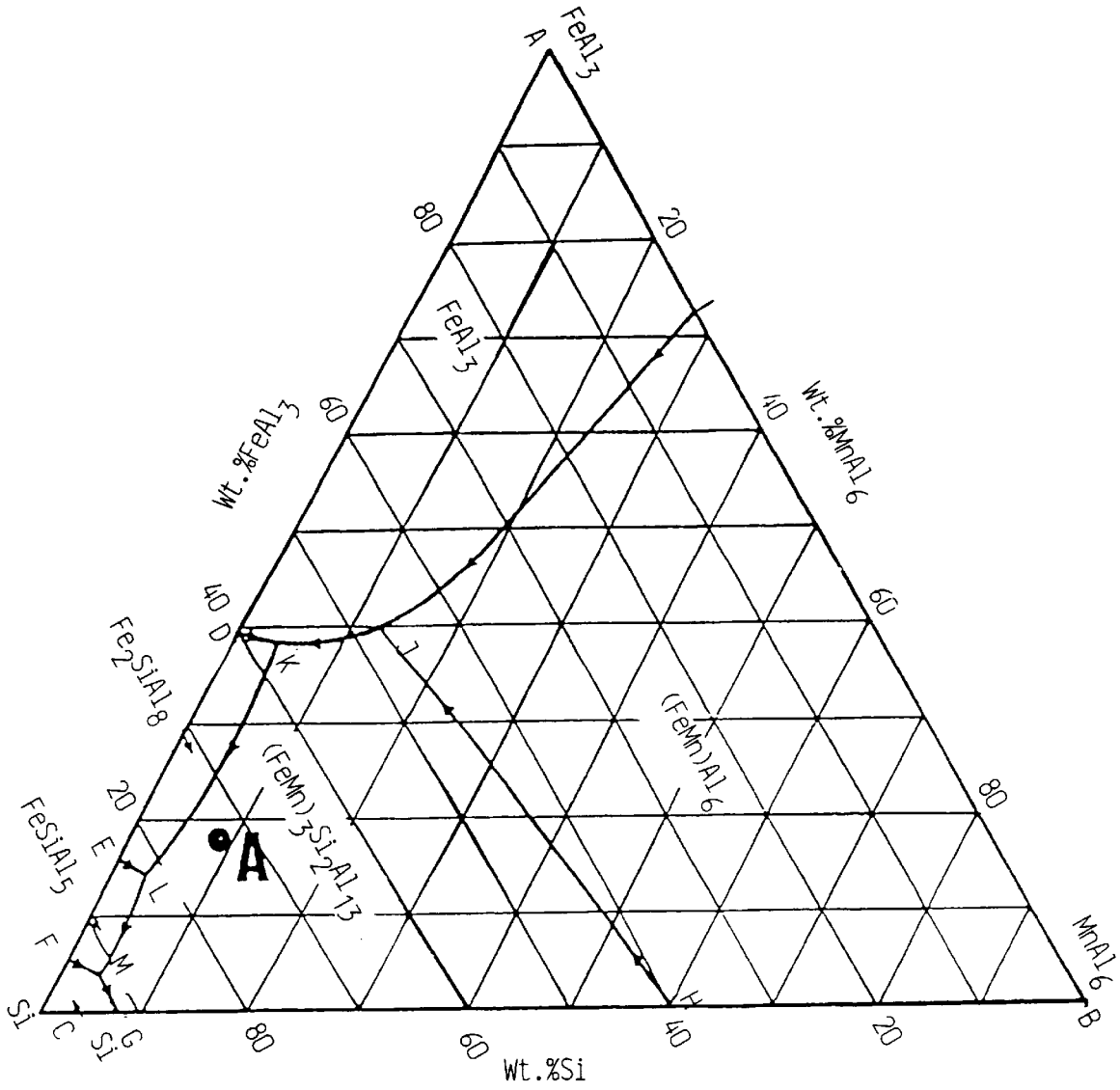
FIG. 1 is a part of the Al-Fe-Mn-Si system as described by Mondolfo. It discloses the Si-$FeAl_3$-$MnAl_6$-equilibrium phase diagram.

Sample A represents the base alloy and sample B an alloy to which Ti and Sr were added in amounts of 0.1% and 0.04%, respectively. Ti was added to the melt in the form of an Al-5% Ti-0.6% B alloy and Sr in the form of an Al-10% Sr alloy, the former gave rise to a B content of 0.012% in the melt. The position of both alloys lies within the $(Fe,Mn)_3Si_2Al_{15}$ area in the Si-$FeAl_3$-$MnAl_6$-equilibrium phase diagram and can be represented by point A in FIG. 1.

About 1 kg of the alloy was melted in a resistance furnace and kept at 800 C. Additions were made and the melt was held for 25 minutes at this temperature. Thereafter the solidification process was investigated by thermal analysis as described by Bäckerud et al in "Solidification Characteristics of Aluminium Alloys", AFS/Skanaluminium, Vol. 1, 1986. The graphite crucible was preheated to 800 C., filled with the melt, placed on a fibrefrax felt, covered with a fibrefrax lid and allowed to cool freely, which led to a cooling rate of approximately 1K/s. Samples were taken 10 mm above the bottom of the crucible for metallographic examination.

In order to examine the nucleation and growth process of the iron containing intermetallic phases, specimens were also quenched in water at specific solidification times.

The solidification process was analysed by conventional thermal analysis as described in the reference given above. Thermal analysis data was collected in a computer in order to calculate rate of solidification (dfs/dt) and fraction solid (fs) versus time (t). The solidification process was represented by plotting the solidification rate (relative rate of phase transformation)(dfs/dt)as a function of the fraction solid (fs). Curve A (FIG. 2) is from the solidification of the base alloy and curve B is that of sample B,(0.1% Ti and 0.04% Sr added).

The solidification of the base alloy, curve A, follows the scheme:

Reaction 1 Development of dendritic network

Reaktion 2 Precipitation of AlMnFe containing phases

Reaction 3 Main eutectic reaction

Reaction 4 Formation of complex eutectic phases

Figure 2A:
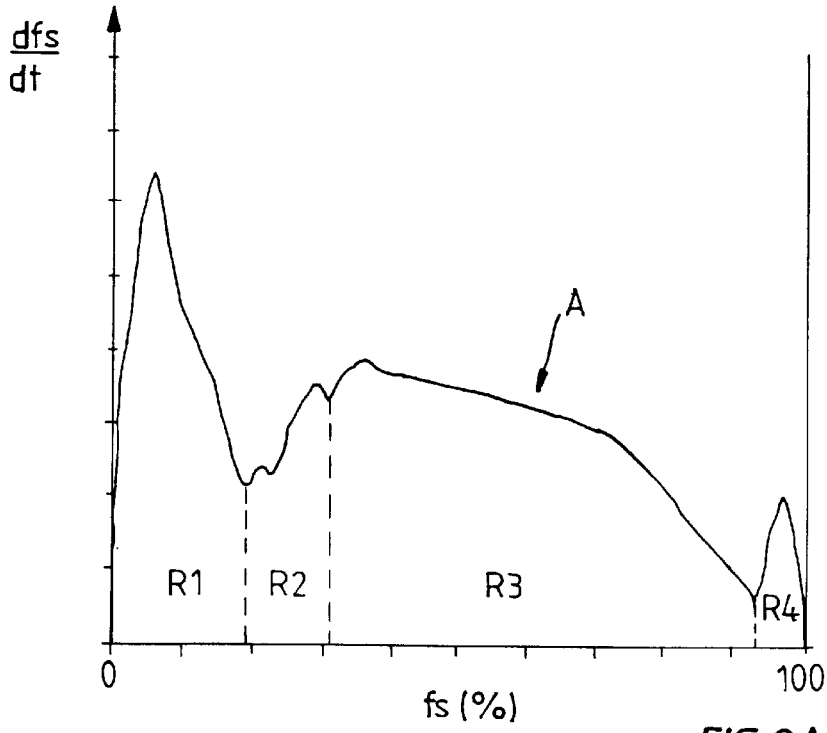
FIG. 2 shows principally the result of a thermal analysis of an aluminium A380-type alloy, wherein the solidification rate (relative rate of phase transformation)(dfs/dt) has been represented as a function of the fraction solid (fs).
Figure 2B:
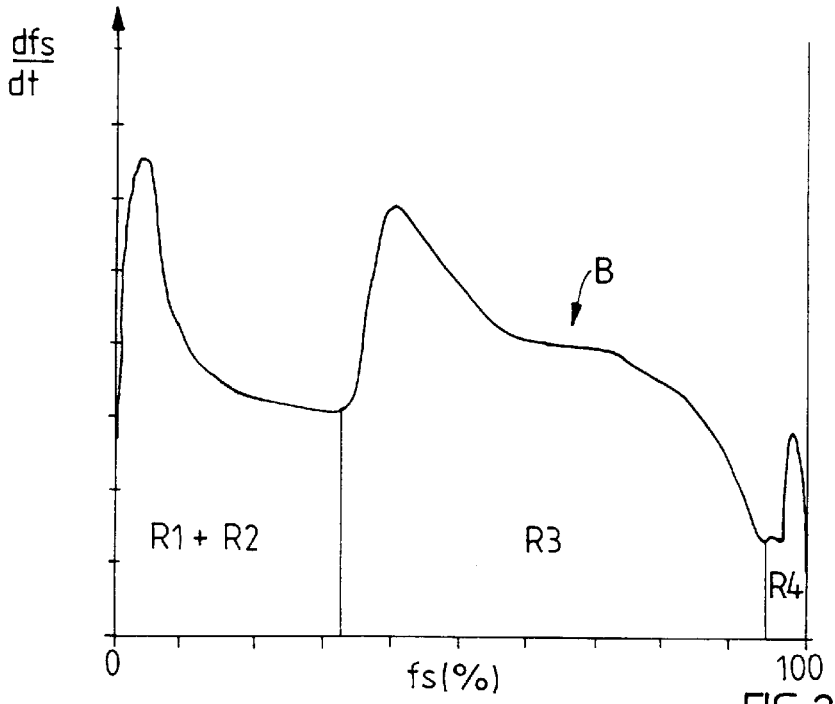

The metallographic examiniation of the microstructure of sample A revealed both beta-phase of the $Al_5FeSi$-type and $Al_{15}Fe_3Si_2$-type phase as iron containing intermetallic phases. In the polished section the platelet-like beta-phase appeared as large needles and the $Al_{15}Fe_3Si_2$-type phase as chinese script. The solidification of sample A can be described in the following manner in relation to FIG. 1, where point A represents the composition of the alloy: First aluminium dendrites are precipitated and thereafter $Al_{15}Fe_3Si_2$ starts to pricipitate. Mn and Fe are then consumed and point A moves towards the $Al_5FeSi$ area. As a result $Al_5FeSi$ (beta phase) starts to precipitate shortly after the $Al_{15}Fe_3Si_2$-phase. In FIG. 2 the preciptation of primary aluminium is represented by R1 and the precipitation of the intermetallic phases are represented by the two peaks in the R2 area.

The solidification of sample B followed curve B in FIG. 2. In this case it is to be noted that no peak for reaction 2 could be observed and that reaction 3 was postponed. A detailed analysis of the data collected during the thermal analysis showed that by the additions made to sample B the liquidus temperature rose about 6 K (the liquidus line KM in FIG. 1 moves towards the $Al_{15}Fe_3Si_2$-area) and the main eutectic reaction was postponed and occured at a lower temperature. This favours point A to be in or closer to the $Al_8Fe_2Si$-area. As a result, the fraction solid (fs) at start of the main eutectic reaction (reaction 3) was increased and in a polished section of this sample neither beta-phase of the $Al_5FeSi$-type nor $Al_{15}Fe_3Si_2$-phase could be identified. The iron intermetallic phase precipitated was identified to be the hexagonal $Al_8Fe_2Si$-type phase which occured as small, mainly faceted, particles. Quenching experiments showed that $Al_8Fe_2Si$-type particles started to precipitate at nearly the same time as the precipitation of dendritic aluminium. This faceted phase was found to decrease in size and change its morphology from faceted to spheroidal with increasing cooling rate. At higher cooling rates, the faceted particles became rather small and homogeneously distributed.

All thermodynamic and kinetic factors influencing the formation of iron containing intermetallic phases are not known in detail. However, it is thought that the addition of one ore more regulating agents, made in accordance with this invention to regulate the condition of crystallization, acts in one or more of the following ways on the formation of the $Al_8Fe_2Si$-type phase:

1. Increase in liquidus temperature (eg Ti, Zr).
2. Decrease of the eutectic temperature (eg Sr).
3. Displacement of the starting point in the phase diagram (Fe).
4. Inocculation of the $Al_8Fe_2Si$-type phase.

The first two points have already been discussed in relation to the solidification of sample B.

The third mechanism is mainly related to the iron content of the starting alloy. The iron content infuences the solidification path in two ways; firstly, the starting point in the Si-$FeAl_3$-$MnAl_6$-equilibrium phase diagram is moved towards the iron rich corner of the phase diagram and, secondly, the residual interdendritic melt will enrich more heavily in iron due to segregation. As a result thereof the melt will first reach the $Al_8Fe_2Si$ area and cause $Al_8Fe_2Si$-type phase to precipitate. Finally, it is plausible that complex boride phases form in the melt, eg as a result of the use of master alloys for alloying and/or grain refining purposes. These master alloys often contain borides which, in turn, are known to react with other elements in the melt (such as Sr, Ca, Ni and Cu) to form mixed boride phases. As an example, if Sr is present in the melt it will react with the boride particles $AlB_2$ or $TiB_2$ to form mixed borides having increased cell parameters as compared to the pure $AlB_2$ or $TiB_2$. As a result thereof, the misfit between the hexagonal $Al_8Fe_2Si$-type phase and the hexagonal borides will decrease and, hence, favour the nucleation of $Al_8Fe_2Si$-type phase on the mixed borides.

However, the most important finding is that the precipitation of the platlet-shaped beta-phase of the $Al_5FeSi$-type can be suppressed by a primary precipitation of the hexagonal $Al_8Fe_2Si$-type phase. It is thought that the precipitation of beta-phase is not inhibited by the presence of said $Al_8Fe_2Si$-type phase but that the beta phase cannot develop the common platlet morphology since it will nucleate and precipitate on the $Al_8Fe_2Si$-type phase. Accordingly, the iron containing intermetallics formed must be supposed to have a core of the hexagonal $Al_8Fe_2Si$-type phase covered with a layer of the monoclinic beta-phase of the $Al_5FeSi$-type. Since the morphology of these "duplex" intermetallic particles is governed by the $Al_8Fe_2Si$-type phase no platlets are formed and the porosity in the solidified structure will be a considerably decreased. Consequently, the mechanical properties of the final product will improve, in particular the fatigue strength.

Figure 3A:
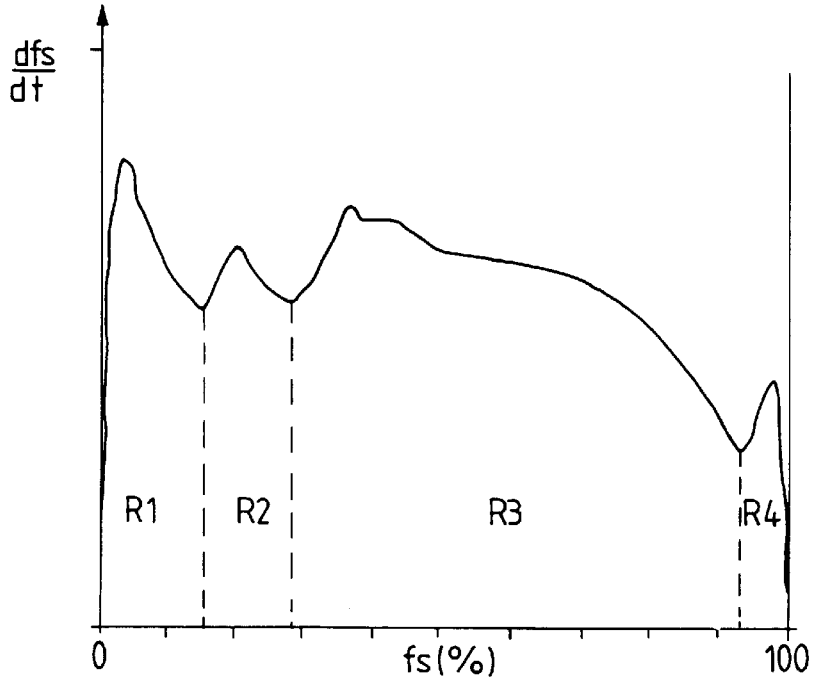
FIG. 3*a* discloses the result prior to regulation of the crystallization path and FIG. 3*b* shows the result after addition of the precipitation regulating agents(0.15% Ti and 0.02% Sr).
Figure 3B:
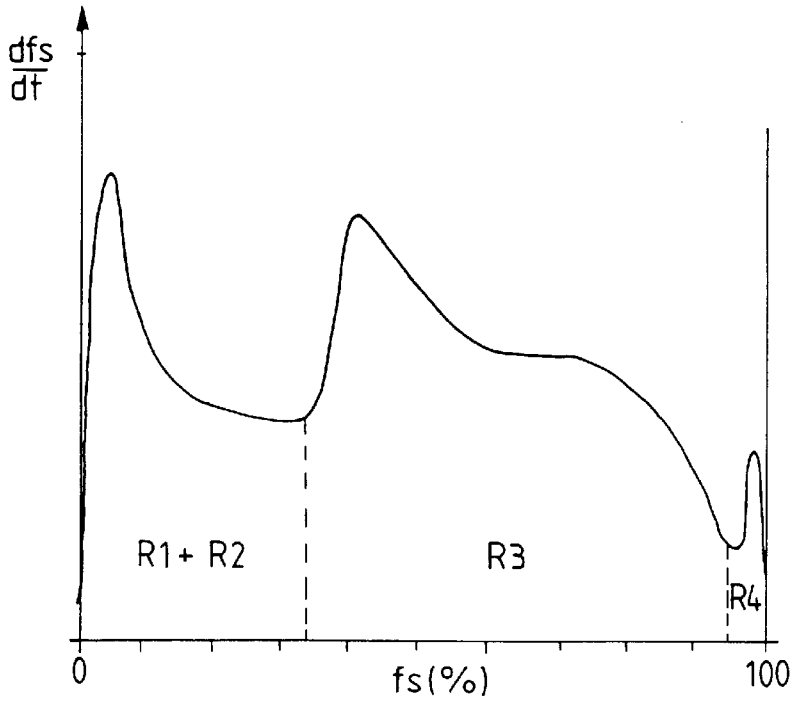

The use of thermal analysis for controlling the morphology is further exemplified in relation to sample C which is a boron alloyed (0.1% B) A380-type alloy. A sample of this alloy was taken and analysed by thermal analysis in the same manner as previously described. By analysing the curve of the thermal analysis, FIG. 3*a*, the precipitation of beta-phase could easily be determined and it could also be determined that the precipitation started early (ie at a low fs). In order to regulate the precipitation path during solidification such that the precipitation of the iron containing intermetallic phases starts with the precipitation of the hexagonal phase of the $Al_8Fe_2Si$-type a regulating agent was added to the melt in an amount of 0.15% Ti and 0.02% Sr. The precipitation path during solidification was reinvestigated by thermal analysis, FIG. 3*b*, the absence of the R2-peak and, hence, primary beta-phase is apparent. The melt was then subjected to casting.

Metallographic samples were taken from both samples as well as from the final product and examined by standard metallographic techniques. In the polished section of the uncorrected sample C, large and long needles of beta-phase was observed. However, the structure of the sample examined after correction as well as that of the final product no needles of beta-phase were observed. The iron containing intermetallic phase precipitated appeared as a large number of small faceted particles as typical for the $Al_8Fe_2Si$-type phase.

Although, thermal analysis is a preferred method to investigate the solidification path and to identify the precipitation of beta-phase other methods may be used depending on local factors such as: production program, time limitations and prevailing facilities. From the examples given above it is apparent that the phases precipitated and their morphology can be identified by conventional metallographic examination of a solidified sample. Accordingly, by analysing the structure of a sample solidified at a desired solidification rate, it would be possible to examine the mor-phology of the precipitated phases and thereby to identify the precence of beta-phase in the structure. The conditions of crystallization could then be corrected by addition of one or more of the modifying agents Fe, Ti, Zr, Sr, Na and Ba one or more times, if necessary, in order to obtain the desired precipitation path. However, this controlling method is deemed to take longer time than thermal analysis. Alternatively, the chemical analysis might be used to calculate the activities of the elements in the melt, the position of the melt in the actual phase diagram, the segregation during solidification and so forth. These data could then be used, alone or in combination with an expert system, for calculation of the solidification path of the alloy. In addition, additions necessary to ensure that the precipitation of the iron containing intermetallic phases starts with the precipitation of the hexagonal phase of the $Al_8Fe_2Si$-type could possibly be calculated for the desired solidification rate. However, at present no such system is fully developed to suit foundry practice.

What is claimed is:

1. A method for producing an iron containing hypoeutectic aluminium alloy free from primary platelet-shaped beta-phase of the $Al_5FeSi$-type in the solidified structure by the steps of a) providing an iron containing aluminium alloy having a composition within the following limits in weight %:
Si 6–10
Mn 0.05–1.0
Fe 0.4–2.0
at least one of
1) Ti and/or Zr 0.01–0.8
2) Sr and/or Na and/or Ba) 0.005–0.5
optional one or more of
Cu 0–6.0
Cr 0–2.0
Mg 0–2.0
Zn 0–6.0
B 0–0.1
balance Al apart from impurities, b) controlling and regulating the precipitation path during solidification such that the precipitation of Fe containing intermetallic phases starts with the precipitation of the hexagonal phase of the $Al_8Fe_2Si$-type by b1) regulating the condition of crystallization by addition of one or more of Fe, Ti, Zr, Sr, Na and Ba within the limits specified in step a) and b2) identifying the phases and/or the morphology of the phases that precipitate during the solidification and, if necessary, correct the addition one or more times in order to obtain the desired precipitation path, and c) solidifying the alloy at the desired solidification rate.

2. A method according to claim 1 wherein the identification of the phases and/or the morphology of the phases that pre-cipitates during the solidification is performed by at least one of thermal analysis, metallographic method and numerical calculation.

3. A method according to claim 1 wherein the condition of crystallization in step b1) is per-formed by the addition of Ti.

4. A method according to claim 1 wherein the condition of crystallization in step b1) is per-formed by the combined addition of Ti and Sr.

5. A method according to claim 1 wherein the condition of crystallization in step b1) is per-formed by the addition of Fe.

6. A method according to claim 1 wherein the solidifcation rate is <150 K/s.

7. A method according to claim 1 wherein the composition of the liquid alloy lies within the $(Fe,Mn)_3Si_2Al_{15}$-area in the $Si$-$FeAl_3$-$MnAl_6$-equilibrium phase diagram.

8. A method according to claim 1 wherein the aluminium alloy has a composition within the following limits in weight %:
Si 7–10
Mn 0.15–0.5
Fe 0.6–1.5
Cu3–5.

9. A method according to claim 1 wherein the aluminium alloy has a composition within the following limits in weight %:
Si 8.5–9.5
Mn 0.2–0.4
Fe 0.8–1.2
Cu3.0–3.4

10. A method according to claim 1 wherein the element or elements regulating the condition of crystallization is added in the form of a master alloy.

11. A method according to claim 1 characterized in that the phases and/or the morphology of the phases that precipitate during the solidification is identified by using thermal analysis.

12. A method according to claim 11 wherein the data of the thermal analysis is used for controlling and regulating the preci-pitation path during solidification such that the precipi-tation of Fe containing intermetallic phases starts with the precipitation of the hexagonal phase of the $Al_8Fe_2Si$-type.

13. A method according to claim 3 wherein the amount of Ti added is 0.1–0.3% Ti.

14. A method according to claim 3 wherein the amount of titanium addition is 0.15 to 0.25% Ti.

15. A method according to claim 4 wherein the amount of titanium added is 0.1–0.3% Ti and the amount of strontium added is 0.005–0.03% Sr.

16. A method according to claim 4 wherein the amount of titanium added is 0.15–0.25% Ti and the amount of strontium added is 0.01–0.02% Sr.

17. A method according to claim 5 wherein the amount of iron added is 0.5–0.15% Fe.

18. A method according to claim 5 wherein the amount of iron added is 0.5–1.0% Fe.

19. A method according to claim 6 wherein the solidification rate is <100 Ks.

20. A method according to claim 6 wherein the solidification rate is <20 Ks.

21. A method according to claim 10 wherein said master alloy contains particles with a hexagonal structure.

22. A method according to claim 10 wherein said master alloy contains a nucleating agent for the $Al_8FeSi_2$ phase.

23. An iron-containing hypoeutectic aluminum-silicon alloy free from platelet-shaped beta-phase of the $Al_5FeSi$-type having a composition within the following limits in weight percent:
Si 6–10
Mn 0.05–1.0

Fe 0.4–2.0 at least one of

1) Ti and/or Zr 0.01–0.8

2) Sr and/or (Na and/or Ba) 0.005–0.5 optionally one or more of

Cu 0–6.0

Cr 0–2.0

Mg 0–6.0

Zn 0–6.0

B 0-0.1 balance Al apart from impurities, and containing a hexagonal phase of the $Al_{18}FeSi_2$ type as the primary precipitated Fe-containing intermetallic phase.

24. An alloy according to claim 23 having a composition within the following limits in weight percent:

Si 7–10

Mn 0.15–0.5

Fe 0.6–1.5

Cu 3–5.

25. An alloy according to claim 23 having a composition within the following limits in weight percent:

Si 8.5–9.5

Mn 0.2–0.4

Fe 0.8–1.2

Cu 3.0–3.4.

* * * * *

UNITED STATES PATENT AND TRADEMARK OFFICE

CERTIFICATE OF CORRECTION

PATENT NO. : 6,267,829 B1
DATED : July 31, 2001
INVENTOR(S) : Backerud et al.

It is certified that error appears in the above-identified patent and that said Letters Patent is hereby corrected as shown below:

Column 9,
Line 12, delete ""$Al_{18}FeSi_2$" and replace by -- $Al_8FeSi_2$ --.

Signed and Sealed this

Ninth Day of April, 2002

*Attest:*

*Attesting Officer*

JAMES E. ROGAN
*Director of the United States Patent and Trademark Office*